United States Patent [19]

David

[11] Patent Number: 4,651,474

[45] Date of Patent: Mar. 24, 1987

[54] WIDE BELT SANDING MACHINE WITH PLATEN OSCILLATING MEANS

[75] Inventor: Eugene C. David, New Hope, Minn.

[73] Assignee: Timesavers, Inc., Minneapolis, Minn.

[21] Appl. No.: 874,342

[22] Filed: Jun. 13, 1986

Related U.S. Application Data

[63] Continuation of Ser. No. 643,701, Aug. 24, 1984, abandoned.

[51] Int. Cl.[4] ..... B24B 21/22

[52] U.S. Cl. ..... 51/138; 51/141; 51/142

[58] Field of Search ..... 51/57, 58, 60, 62, 170 MT, 51/170 EB, 137, 138, 139, 141, 142

[56] References Cited

U.S. PATENT DOCUMENTS

| | | | |
|---|---|---|---|
| 1,927,330 | 9/1933 | Williams | 51/138 |
| 1,936,991 | 11/1933 | Pinkney | 51/141 X |
| 2,195,065 | 3/1940 | Wallace | 51/60 |
| 2,586,848 | 2/1952 | Miller | 51/141 |
| 2,804,723 | 9/1957 | Sweeney | 51/38 |
| 2,926,465 | 1/1960 | Sommers | 51/142 |
| 3,079,734 | 3/1963 | Eschenburg | 51/142 |
| 3,094,815 | 6/1963 | Pendergast | 51/60 |
| 3,394,501 | 7/1968 | Carlson et al. | 51/138 |
| 3,654,739 | 4/1972 | Stoy et al. | 51/141 |
| 3,701,219 | 10/1972 | Sternal | 51/140 |
| 3,715,839 | 2/1973 | Heesemann | 51/141 X |

FOREIGN PATENT DOCUMENTS

| | | | |
|---|---|---|---|
| 594069 | 3/1960 | Canada | 51/58 |

*Primary Examiner*—Robert P. Olszewski

*Attorney, Agent, or Firm*—Orrin M. Haugen; Thomas J. Nikolai; Frederick W. Niebuhr

[57] ABSTRACT

An endless abrasive belt surface treating apparatus which includes a platen assembly arranged to move in an oscillatory or epicyclic pattern relative to the work surface. The apparatus includes a rotary eccentric crank or drive for drivably oscillating the platen as well as the belt guiding rolls adjacent the platen, with such oscillatory or epicyclic motion being continuously applied while workpieces are being carried through the machine.

2 Claims, 4 Drawing Figures

WIDE BELT SANDING MACHINE WITH PLATEN OSCILLATING MEANS

This application is a Continuation of application Ser. No. 643,701, filed Aug. 24, 1984 and now abandoned.

BACKGROUND OF THE INVENTION

The present invention relates generally to an endless abrasive belt surface treating apparatus, or a wide belt sanding machine, and more particularly to an improved platen for such an apparatus having means for driving the platen along with the work-contacting portion of the abrasive belt in an oscillatory or epicyclic pattern while work is being carried through the machine. Specifically, the improved wide belt sander of the present invention employs a belt driving system having an oscillating platen portion, and with the nature of the active contact between the abrasive belt surface and the work surface being controlled in part by the motion of the platen.

Wide belt sanders utilizing stationary platens are known in the prior art, with one such system being disclosed in U.S. Pat. No. 3,832,807, Kiser et al, assigned to the same assignee as the present invention. Additionally, other such wide belt sanders with stationary platens are shown in U.S. Pat. No. 3,429,079 for example.

In a typical platen head wide belt sanding machine, there is provided a platen base forming a sanding head and with an endless abrasive belt trained over a plurality of rollers or drums, one of which is power driven, the balance being idlers. The platen is interposed between a pair of belt guiding rollers. In the present arrangement, the drive roller is preferably disposed at the upper apex zone of the belt, with the rollers or drums disposed on either side of the platen normally being idlers and adapted to move in an orbital path with the platen per se.

Typically, in the present device, work is fed into the machine by a feed system or conveyor assembly that comprises an endless horizontally oriented conveyor belt, the upper span or flight of which cooperates with pinch-rolls so as to grip the work and feed it through the machine at a uniform rate. During this operation, of course, the top surface of the work is arranged in contact with the abrasive belt. In order to accommodate and adapt the apparatus to workpieces having different thicknesses, the conveyor assembly is adjustable either upwardly or downwardly toward or away from the wide belt assembly, which is normally supported against the force or thrust of work arranged on the conveyor belt.

Wide belt sanding apparatus with adjustable conveyors are disclosed in U.S. Pat. No. 3,832,807 referred to hereinabove, and reference is made to the disclose in that patent for the details of conveyor design.

SUMMARY OF THE INVENTION

The endless abrasive belt surface treating apparatus of the present invention is intended to perform a sanding operation wherein the portion of the abrasive belt in contact with the work surface is driven in an orbital or epicyclic path relative to the work. The sanding operation, when undertaken with a movable orbiting platen and belt arrangement, provides a highly desirable and uniform finish on wood surfaces, particularly wood surfaces designed for furniture or other similar applications.

Briefly, in accordance with the present invention, means are provided for driving the lower platen and idler rollers of a wide belt sanding assembly along an orbital or epicyclic path while the abrasive belt is in motion, with the abrasive belt being moved continuously at a relatively low rate of speed. This motion enhances the quality of the finishing operation on the surface of certain types of workpieces. In order to provide for substantially continuous operation of the apparatus, air discharge means are provided to reduce and/or eliminate the build up of wood particles or dust on the surface of the abrasive belt.

Therefore, it is a primary object of the present invention to provide an improved wide belt sander apparatus or machine intended to perform a finishing operation on workpieces, and wherein the portion of the abrasive belt in contact with the workpiece and adjacent drive components are driven in an orbital path in order to enhance the finishing operation.

It is still a further object of the present invention to provide an improved platen-idler roll assembly for a wide belt sanding apparatus wherein the platen along with those idler rolls disposed at opposed edges of the platen, are driven in an oscillatory path, and accordingly carry that portion of the abrasive belt in contact with the workpiece in an orbital path.

Other and further objects of the present invention will become apparent to those skilled in the art upon a study of the following specification, appended claims, and accompanying drawings.

IN THE DRAWINGS

Figure 2:
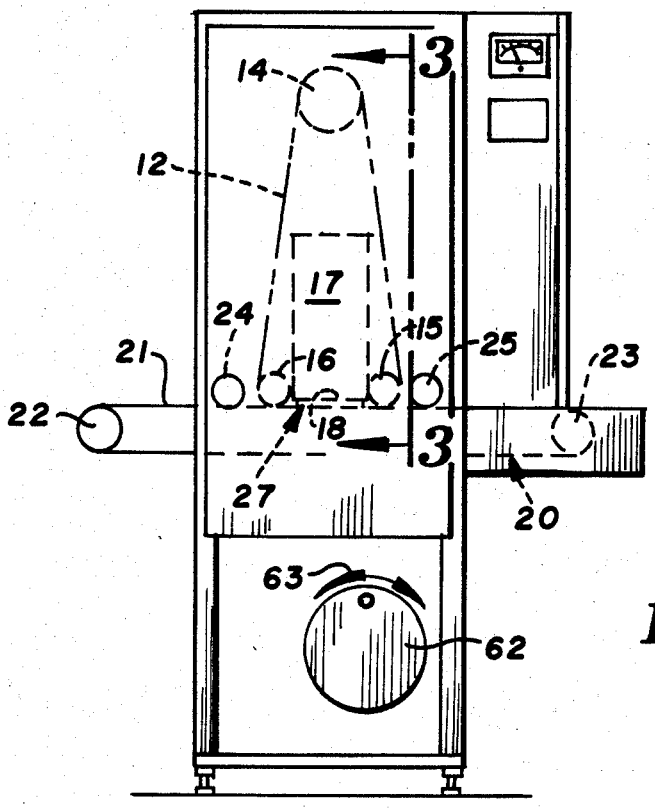
FIG. 2 is a side elevational view of the apparatus illustrated in FIG. 1, with FIG. 2 being taken generally along the line and in the direction of the arrows 2—2 of FIG. 1.
Figure 4:
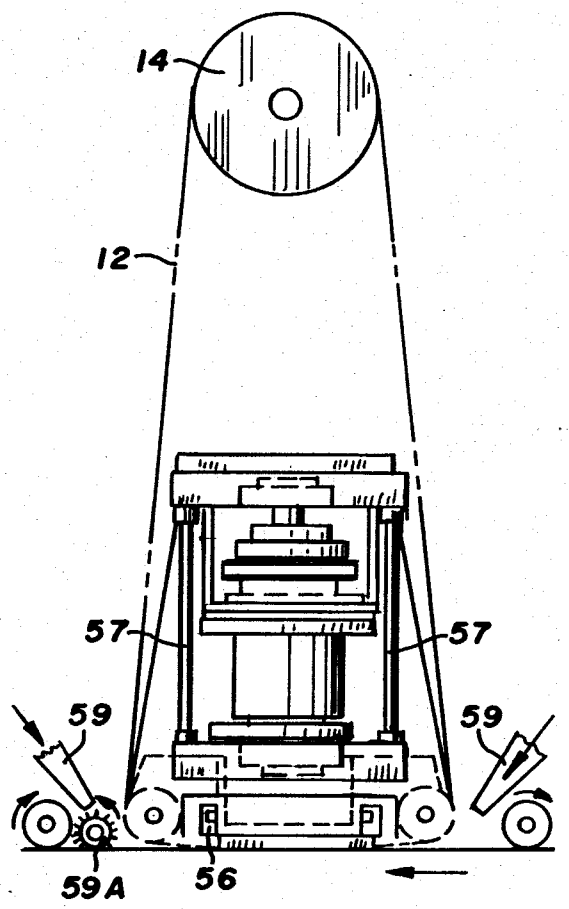
Figure 3:
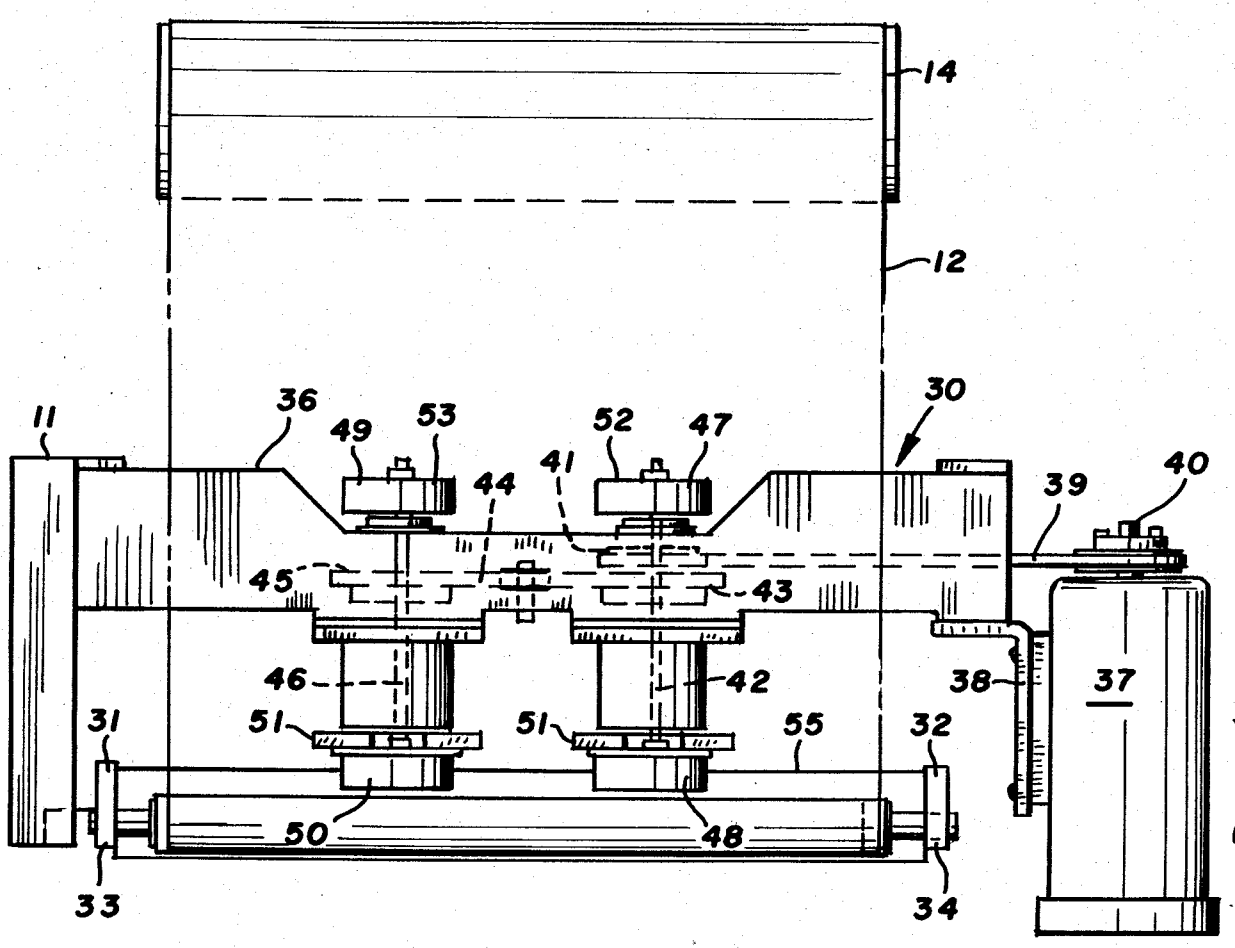

FIG. 3 is a detail elevational view of the platen arrangement of the present invention, with FIG. 3 further showing the arrangement of the rollers or drums over which the wide abrasive belt is trained, with FIG. 3 being taken generally along the line and in the direction of the arrows 3—3 of FIG. 2; and FIG. 4 is a detailed end elevational view of the belt drive and platen assembly as illustrated in FIG. 3.

DESCRIPTION OF THE PREFERRED EMBODIMENT

Figure 1:
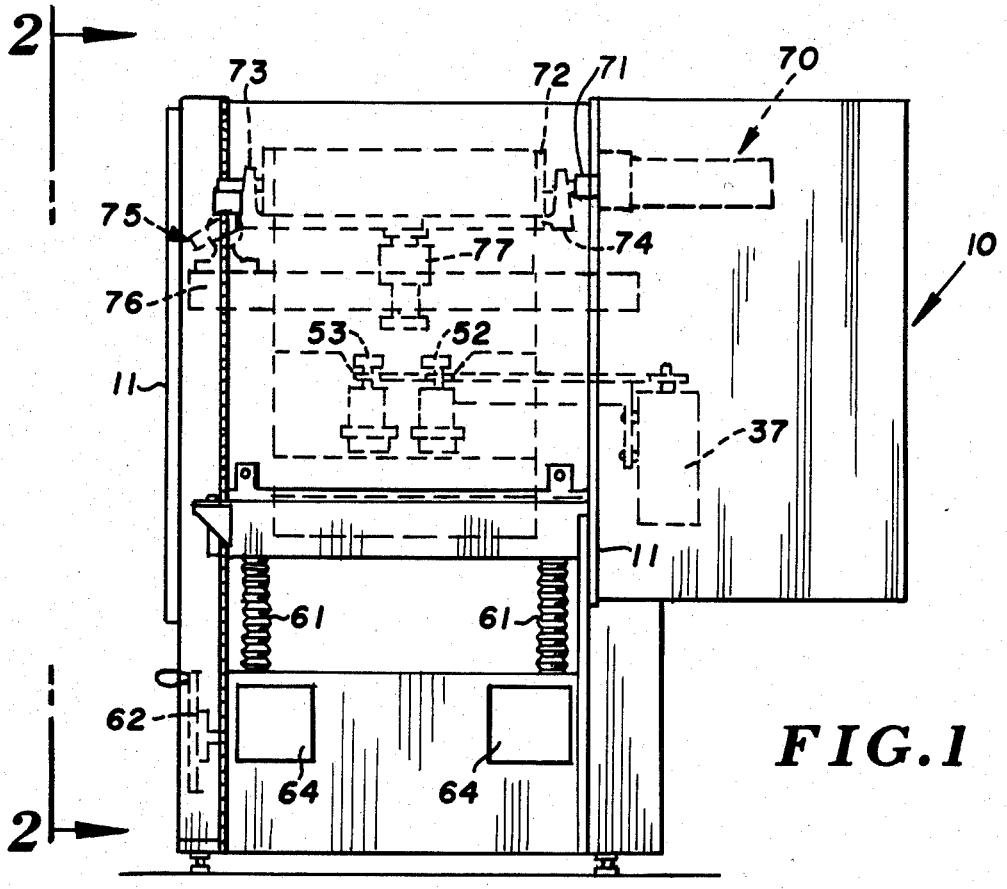
FIG. 1 is an end elevational view of a wide belt sanding apparatus prepared in accordance with the present invention, and with FIG. 1 showing the infeed portion of the machine, and with portions of the machine being shown in section.

In accordance with the preferred embodiment of the present invention, and with particular attention being directed to FIGS. 1 and 2 of the drawings, the endless abrasive belt surface testing apparatus generally designated 10 comprises a main frame structure 11, preferably in the form of a rigid structure, such as a weldment, for supporting a work carrying conveyor and for receiving, guiding, and driving a wide endless abrasive belt 12 about a predetermined path relative to the conveyor. The abrasive belt 12 is a typical endless wide belt having an outer abrasive surface. Such belts are, of course, in common use and commercially available. The belt 12 is trained about three individual drums or rollers, such as the main drive roller 14, and the idler rollers 15 and 16. As is apparent from FIG. 2 of the drawings, idler drums or rollers 15 and 16 are disposed on opposite edge surfaces, such as the leading edge and trailing edge respectively of a platen assembly generally designated 17. Platen assembly 17 includes a base element comprising a pad or platen 18 which is arranged to provide a back-up pad or inner running surface for belt 12 as it moves about its predetermined orbital path. Stated another way, the pad 18 is arranged to provide a working force for the belt to be applied against the work as it moves through the apparatus.

A conveyor means is provided to carry work through the apparatus and into contact with the wide abrasive belt. The conveyor means, generally designated 20, includes a belt 21 having an upper span or flight upon which the work is carried, with the path of the belt being controlled by conveyor rolls 22 and 23, one of which is driven so as to carry the belt on its working path. Pinch rolls 24 and 25 are arranged to cooperate with the belt 21, particularly the upper flight thereof, to both control the forward motion of the work, as well as to function as a holddown for the workpiece as it moves through the zone between the abrasive belt 12 and conveyor belt 21. In this fashion, therefore, platen 18 is arranged to provide a working force against the inner surface of the endless abrasive belt while the belt is trained about and moving over belt path-defining drums 14, 15 and 16.

In the endless abrasive belt work surface treating apparatus 10, and particularly in the endless belt driving portion thereof, drum 14 is powered so as to move the belt about the individual rollers while it is trained about each of the three cylindrical drums. Furthermore, the zone occupied by platen 18, the working portions of abrasive belt 12, and upper surface of conveyor belt 21, may be collectively defined as a working station. In particular, the working station is the zone shown generally at 27.

While workpieces are within the working station 27, the upper surface of the workpiece is arranged to be in contact with and opposed to the abrasive coated outer surface of belt 12. In this fashion, therefore, the surface of the workpiece is abrasively treated, and abraded and/or sanded to its desired surface finish.

The main frame 11 provides a support to which the belt, the cylindrical drums carrying the belt, and the platen are secured in their operative configuration. Specifically, the platen assembly 17 is arranged to move in an orbital path about a horizontal plane, or in other words, in a plane which is parallel to the surface of the work being treated. The mechanism for providing orbital motion to the platen assembly is illustrated in greater detail in FIGS. 3 and 4 of the drawings.

With attention being specifically directed to FIGS. 3 and 4, the platen assembly 17 includes an orbiting frame generally designated 30, including lateral side support rails 31 and 32 having journals therein as at 33—33 and 34—34 for rotatably supporting rollers 15 and 16 therewithin. The rollers or drums 15 and 16 are carried so as to be journaled for axial parallel rotational motion, and are, as indicated, positioned at oppositely disposed leading and trailing edges of the platen 18. Furthermore, orbital motion generating means are coupled to the drive system for providing the orbital motion.

With particular attention being continued to FIG. 3, a rigid cross-beam 36 is provided, being mounted between side frame members of main frame 11. Cross-beam 36 provides a support beam for portions of the abrasive belt driving system, including the drive system for providing the orbital motion. The orbital motion generating means includes drive motor 37, which is coupled through an adjustable bracket 38 to main frame 11. Motor 37 drives endless belt 39, preferably a timing belt, through motor pulley 40, the belt 39 further being trained about pulley member 41. Pulley 41 is fast on shaft 42, and, of course, is rotatable therewith. Pulley member 43 is arranged fast on shaft 42, and carries belt 44, also preferably a timing belt, which, in turn, is trained about pulley 45. Pulley 45 is fast on shaft 46, and rotates therewith.

Shafts 42 and 46 constitute crank shafts for eccentrics disposed at opposed ends thereof. Specifically, eccentrics 47 and 48 are fast upon crank shaft 42, and eccentrics 49 and 50 are fast upon crank shaft 46. The eccentrics include a disc eccentrically mounted on the crank shaft and with the discs being centrally disposed within a cam bearing, such as a roller or needle bearing element. Rotational motion of crank shafts 42 and 46 imparts orbital motion to elements disposed in operative relationship therewith, including the platen assembly 17. Specifically, stabilizing bars 52 and 53 are arranged along the upper surface and adjacent to cross-beam 36, while lower eccentrics 48 and 50 are secured to cross-member 55, which is arranged transversely to and coupled to rails 31 and 32. Each of the crank shafts, specifically crank shaft 42 and 46 is provided with a counterweight 51—51 which equalizes the load imposed upon the orbiting platen assembly, and counter-balances the forces so as to reduce and/or eliminate vibration in the system when operative. Additionally, guide bar means 56 is secured to rails 31 and 32, and is adapted to control and/or restrict the plane of orbital motion for platen assembly 17 by securing pad 18 to the remainder of platen assembly 17. In order to provide support for the overall assembly, support posts 57—57 are provided, generally at the corner locations, and are coupled at their upper ends to stabilizing bars 52 and 53, and at the lower ends to lateral rails 31 and 32, and thus provide a connecting means for the orbiting assembly, and specifically create an orbital open-sided box-like assembly.

As the work moves through the work station, particles removed from the surface of the work may become embedded in the surface of the abrasive belt. In order to assist in reduction of build up of accumulated dust particles, air jets such as air jets 59—59 are provided, with the nozzle portions thereof being directed onto the surface of the work. In order to reduce the discharge of dust into the ambient, a counter-rotating brush or an air-lock paddle drum 59A, which rotates counter to the direction of motion of the work is provided for the dust-ladened air in the zone adjacent belt 12 and nozzles 59. Suitable dust removal hoods are provided, with such dust removal hoods being conventional and in accordance, for example, with those disclosed in U.S. Pat. No. 3,872,627, Schuster, assigned to the same assignee as the present invention.

In order to control the thickness dimension of working stations 27, conveyor 20 is controllably raised and lowered by means of screws, jacks or shafts 61—61, the axial disposition of which are ultimately controlled by crank wheel 62. In other words, rotation of crank wheel 62 in the direction of the double-headed arrow 63 will raise and/or lower the plane of the upper flight of conveyor belt 21. Such an arrangement is, of course, conventional and well-known in the art. Gear boxes 64—64 are provided for imparting axial motion to screw shafts 61—61.

In order to provide the energy needed to move abrasive belt 12, main motor 70 is provided with its output shaft 71 being, in turn, operatively coupled to drum 14 so as to impart motion to belt 12. As is indicated in FIG. 1, roller 14 is journaled in bearings 72 and 73, and, in turn, coupled to cross-member 74. In order to control the axial disposition or belt-tracking, tracking guide assembly generally designated 75 is utilized, with assembly 75 being secured to support bed 76, and operative in accordance with the belt tracking assembly disclosed in U.S. Pat. No. 3,504,458, Rutt. Belt tracking is accomplished further through support shaft 77, with another embodiment of the belt tracking assembly which may be adapted to the apparatus illustrated herein being disclosed in U.S. Pat. No. 3,971,166, and assigned to the same assignee as the present invention.

In operation, therefore, belt 12 is driven about its predetermined path by means of power delivered from motor 70, through roller 14. For most applications, belt 12 moves at a rate of approximately 50 inches per minute, with belt speeds ranging from as low as 20 inches per minute and as high as 600 inches per minute being deemed useful for most applications. Platen assembly 17 is directed in an orbital path by means of power supplied from motor 37, with the orbital path having a motion radius of approximately one-eighth inch for most applications, and moving at a rate of approximately 1,750 cycles per minute, it being understood that orbital motion in the range of from 175 up to 1,750 cycles per minute may be useful. In order to reduce the friction between the under exposed surface of platen 17 and the inner surface of belt 12, a polishing pad in the form of a graphite-loaded hard felt pad is provided. Such graphite-loaded pads are, of course, commercially available.

What is claimed is:

1. In an endless abrasive belt surface treating apparatus having a main frame means, guide means for receiving, guiding and driving an endless abrasive belt with an abrasive coated outer surface about a predetermined path while trained about a plurality of cylindrical drums, drive means for drivably rotating a first one of said cylindrical drums, a platen means having a substantially planar surface disposed between a second and a third drum of said cylindrical drums, defining in said second and third drums a spaced pair of cylindrical drums, and arranged to apply a working force against the inner surface of said endless abrasive belt while said abrasive belt is trained about said spaced pair of cylindrical drums, conveyor means having a conveyor belt for supporting workpieces with surfaces in contact with and opposed to said abrasive coated outer surface beneath said platen means and defining a belt working station in the zone between the portion of said abrasive belt disposed between said spaced pair of cylindrical drums and said conveyor belt, said abrasive belt surface treating apparatus being characterized in that:

said main frame includes a support beam for supporting said guide means, with a predetermined portion only of said guide means being arranged for orbital motion relative to said frame means;

said predetermined portion of said guide means consisting essentially of an orbiting frame and comprising rail means having journals thereon for rotatably supporting said spaced pair of cylindrical drums in axial parallel relationship and for retaining said platen means between said pair of cylindrical drums;

orbital motion generating means coupled to said main frame means and arranged to impart motion to said predetermined portion of said guide means along an orbital path and in a plane of motion parallel to the axes of said spaced pair of cylindrical drums and to the plane of said surface of said platen means; and said orbital motion generating means comprising a pair of generally parallel eccentric drives, each of said eccentric drives including a crank shaft journaled for rotation within said support beam and with each crank shaft being coupled at its opposed ends to eccentric members, wherein said ortibal motion generating means imparts orbital motion to said spaced pair of cylindrical drums and to said platen means.

2. The endless abrasive belt surface treating apparatus of claim 1, further including counter-weights secured to said crank shafts for reducing vibratory forces during rotation thereof.

* * * * *